US006981760B2

(12) United States Patent
Yamamoto

(10) Patent No.: US 6,981,760 B2
(45) Date of Patent: Jan. 3, 2006

(54) INK JET HEAD AND INK JET PRINTER

(75) Inventor: Ryoichi Yamamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 10 days.

(21) Appl. No.: 10/255,585

(22) Filed: Sep. 27, 2002

(65) Prior Publication Data

US 2003/0058308 A1 Mar. 27, 2003

(30) Foreign Application Priority Data

Sep. 27, 2001 (JP) ..... 2001-296299

(51) Int. Cl.
*B41J 2/02* (2006.01)

(52) U.S. Cl. ..... 347/75

(58) Field of Classification Search ..... 347/61, 347/63, 64, 75, 205
See application file for complete search history.

(56) References Cited

U.S. PATENT DOCUMENTS 4,336,548 A * 6/1982 Matsumoto ..... 347/64
4,686,544 A * 8/1987 Ikeda et al. ..... 347/64
5,252,988 A * 10/1993 Katayama et al. ..... 347/205
6,341,848 B1 1/2002 Shade et al.

FOREIGN PATENT DOCUMENTS

JP 2001-191529 7/2001

* cited by examiner

*Primary Examiner*—K. Feggins
(74) *Attorney, Agent, or Firm*—Whitham, Curtis & Christofferson, P.C.

(57) ABSTRACT

There is provided an ink jet head for ejecting an ink liquid drop from an ink jet nozzle onto a recording medium, wherein, on a substrate having a heat conductivity of 15 (W/m/K) or less, a heat-transfer layer having a thickness of 10 $\mu$m or more is formed, and a heat insulating layer is adjacently formed on top of the heat-transfer layer; and a heat generating heater, which has a thin film resistor for boiling a part of ink to generate a bubble and allow the ink liquid drop to be ejected from the ink jet nozzle by an expansion of the bubble and a thin film conductive electrode for supplying a current to the thin film resistor, is adjacently formed on top of the heat insulating layer. There is also provided an ink jet printer using the above ink jet head. The ink jet head and the ink jet printer as above make it possible to suppress the temperature elevation around the heat generating heater and yet enhance the printing speed upon the printing even if the ink liquid drop is continuously ejected.

28 Claims, 4 Drawing Sheets

INK JET HEAD AND INK JET PRINTER

BACKGROUND OF THE INVENTION

1. Field of the Invention

The present invention relates to a thermal type ink jet head for ejecting an ink drop from an ink jet nozzle (ink ejecting nozzle) onto a recording medium by using a heat generating heater and an ink jet printer using the ink jet head.

2. Description of the Related Art

In the case where an ink jet head of a thermal type ink jet printer is of, for example, a top shooter type for ejecting an ink liquid drop substantially in a perpendicular direction to a head substrate, the ink jet head has a thin film resistor formed on a semiconductor substrate such as a silicon substrate that is a head substrate, an ink jet nozzle provided substantially above this thin film resistor, and an ink flow passage formed through a partitioning wall layer on the semiconductor substrate in communication with this ink jet nozzle, thereby rapidly boiling a part of the ink within the ink flow passage and generating bubbles to eject the ink liquid drop substantially in the perpendicular direction to the substrate from the ink jet nozzle.

It is desired that a diameter of the ink jet nozzles is reduced and the ink jet nozzles are arranged in higher density so that an image of high quality may be printed on a recording paper at a higher resolving power. On the other hand, it is desired that a longitudinal head in which the ink jet nozzles are arranged on a large scale, i.e., a line head in which the ink jet nozzles are arranged at full width length of the recording paper of, for example, A4 size, is developed so that the print with a high quality and the higher resolving power may be outputted for a short period of time.

In this case, it is general to use a silicon substrate as the substrate in view of the easiness of the manufacture of the ink jet head in order to form the heat generating heaters in one-to-one relation with the ink jet nozzles on the substrate. However, since the ink jet head produced by the silicon substrate is cut and manufactured from the silicon wafer having a predetermined size such as a six-inch size or the like, an expensive silicon wafer having a large size has to be used for manufacturing the longitudinal head. Furthermore, since the longitudinal head length is also limited by the size of the silicon wafer, it is impossible to make the above-described line head from a single substrate in a one-chip manner, and in addition it is impossible to manufacture the line head at low cost.

On the other hand, it is conceivable to manufacture an ink let head by using a glass substrate that is relatively less costly and freer in size than the silicon substrate that is thus costly and not free in size.

For instance, in JP 2001-191529A, there is disclosed an ink jet head having a structure of a heat sink layer having a thickness of 1 to 2 $\mu$m and a high thermal conductivity which is made of a metal such as aluminum, copper and gold on top of a soda lime glass substrate; an insulating layer on top thereof; a heat generating heater composed of a resistor layer and a conductive layer on top thereof; and a protective layer on top thereof.

In this case, since the metal heat sink layer is located below the heat generating heater layer, it is considered to have a function for rapidly diffusing thermal energy generated from the heat generating heater and opening the heat.

However, in such a head structure, when the density of the ink jet nozzles is increased, for example, the density of the ink jet nozzle is increased to 600 npi (nozzle/inch) or more, the heat generating heaters are integrated at a high density.

Further, when the ink liquid drop is ejected at an ink jet (ejecting) cycle corresponding to 10 kHz or more, the case is widely found out in which the release of the heat generated in the heat generating heater cannot catch up with the heat generation so that the temperature around the heat generating heater is elevated and the continuous let of the ink liquid drop becomes impossible.

Since the thermal conductivity of the metal heat sink layer is extremely high, it is impossible to use material having higher thermal conductivity than that.

SUMMARY OF THE INVENTION

Accordingly, in order to overcome the above-noted defects, an object of the present invention is therefore to provide an ink jet head that, in an ink jet head for ejecting an ink liquid drop by using a heat generating heater provided on a less expensive substrate with a low thermal conductivity, may eject the ink liquid drop for a long period of time while suppressing the temperature elevation around the heat generating heater even if the nozzle density of the ink jet head is increased, and an ink jet printer using the ink jet head.

In order to attain the object described above, the present invention provides an ink jet head comprising: an ink jet nozzle from which an ink liquid drop is ejected onto a recording medium; a substrate having a heat conductivity of 15 (W/m/K) or less; a heat-transfer layer having a thickness of 10 $\mu$m or more which is formed on the substrate; a heat insulating layer which is adjacently formed on top of the heat-transfer layer; and a heat generating heater which is adjacently formed on top of the heat insulating layer, the heat generating heater having: a thin film resistor for boiling a part of ink to generate a bubble and allow the ink liquid drop to be ejected from the ink jet nozzle by an expansion of the bubble; and a thin film conductive electrode for supplying a current to the thin film resistor.

Preferably, the heat-transfer layer is made of metal selected from the group consisting of Cu, Al and Si.

Preferably, the heat-transfer layer is formed continuously from a top face of the substrate on which the heat generating heater is formed to a back face of the substrate opposite to the top face to surround end portions of the substrate, and a heat release portion for releasing the heat transmitted from the heat generating heater through the heat-transfer layer is formed on the back face of the substrate.

Preferably, the substrate is provided with the heat release portion on the back face opposite to the top face thereof on which the heat generating heater is formed; and a heat-transfer member penetrating the substrate from the top face to the back face and connecting the heat-transfer layer on the top face and the heat release portion on the back face to each other, is formed.

Preferably, the heat insulating layer has a heat conductivity of 0.1 to 10 (W/m/K).

Preferably, the heat insulating layer is made of an Si oxide, an Si nitride, an Si carbide, or a polyimide resin material.

Preferably, the thin film resistor contains Ta metal in the form of a composition.

Preferably, the thin film resistor uses a Ta—Si—O ternary alloy as a resistive material.

Preferably, the heat generating heater has a protective layer having a thickness of 1 $\mu$m or less formed on top of the thin film resistor.

Preferably, the ink jet nozzle is arranged such that an inlet port end of the ink jet nozzle races the thin film resistor formed on the substrate, and the ink liquid drop is ejected from the ink jet nozzle substantially in a direction perpendicular to the substrate.

Preferably, a distance from a heater surface of the heat generating heater to an eject end of the ink jet nozzle is 40 μm or less, and a profile of the inlet port end of the ink jet nozzle is included in a profile of the heater surface of the heat generating heater when projected onto the heater surface of the heat generating heater.

It is preferable that the ink jet head further comprises: a control circuit for controlling driving of the heat generating heater which is formed of polycrystalline silicon layer formed on the substrate.

The present invention provides an ink jet head comprising: an ink jet nozzle from which an ink liquid drop is ejected onto a recording medium, a substrate having a heat conductivity of 15 (W/m/K) or less a heat-transfer layer which is formed; a heat insulating layer which is adjacently formed on top of the heat-transfer layer; and a heat generating heater which is adjacently formed on top of the heat insulating layer, the beat generating heater having: a thin film resistor for boiling a part of ink to generate a bubble and allow the ink liquid drop to be ejected from the ink jet nozzle by an expansion of the bubble; and a thin film conductive electrode for supplying a current to the thin film resistor, wherein the heat-transfer layer is connected to a heat release portion for releasing heat to the ink supplied for ink ejection.

Preferably, a plurality of the heat generating heaters are formed on top of the heat-transfer layer, as being arranged in parallel; and the heat-transfer layer constitutes a wiring pattern which transmits heat from the plurality of heat generating heaters collectively to the heat release portion.

Preferably, the heat release portion is formed on a back face of the substrate opposite to a top face thereof on which the heat generating heater is formed; and the substrate is provided with a heat-transfer member which is intended to penetrate the substrate from the top face to the back face and connect the heat-transfer layer on the top face and the heat release portion on the back face to each other.

Preferably, the substrate has a through hole formed therein for supplying ink for ink ejection from the back face toward the top face of the substrate; and the heat-transfer member is provided along the through hole.

The present invention provides an ink jet printer characterized by using any one of the ink jet heads described above.

DESCRIPTION OF THE PREFERRED EMBODIMENT

The preferred embodiment of the present invention will now be described.

Figure 1A:
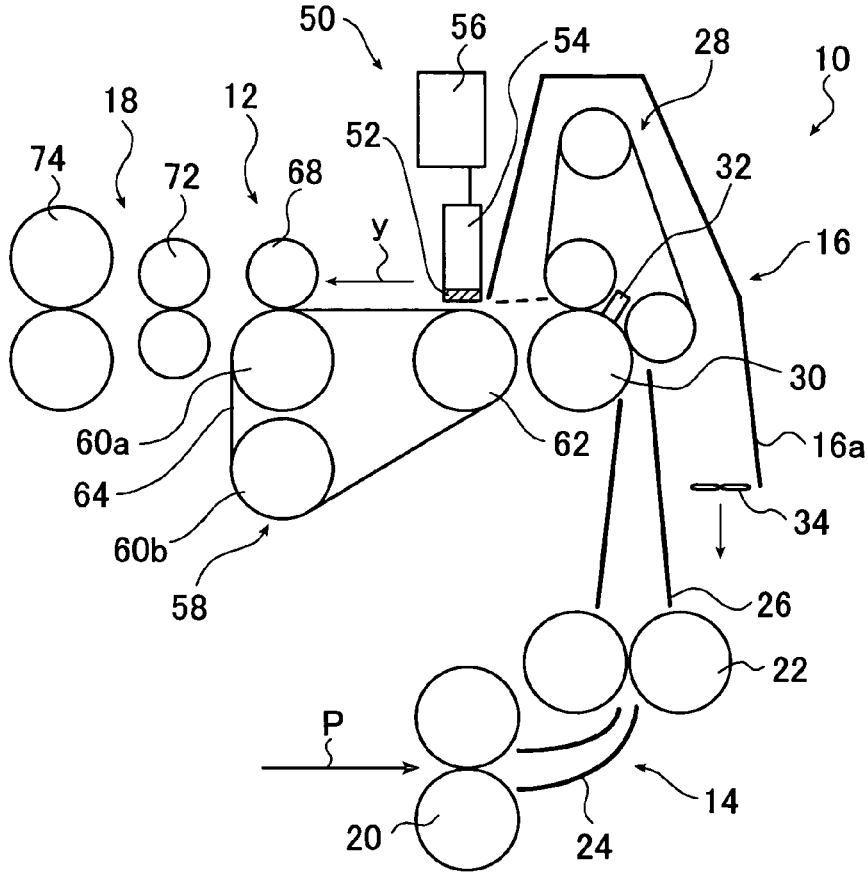
FIG. 1A is a schematic view illustrating a structure of an example of the ink jet printer according to the present invention.
Figure 1B:
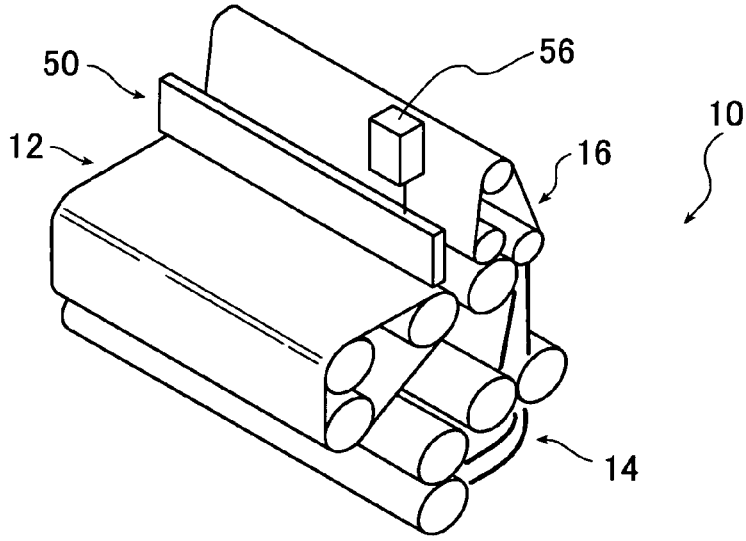
FIG. 1B is a perspective view of the structure shown in FIG. 1A.

FIGS. 1A and 1B show a printer 10 that is one example of an ink jet printer on which an ink jet head according to the present invention is mounted.

FIG. 1A is a schematic structural view of the printer 10 and FIG. 1B is a schematic perspective view thereof.

The printer 10 is an ink jet printer in which an ink jet head 52 is composed of a line head in which a plurality of ink jet nozzles are arranged on a large scale and with a high density in one direction for ejecting ink exceeding at least one side length of a recording medium P such as a recording paper or the like. The printer 10 has a recording portion 12, a feeder portion 14, a preheat portion 16 and a discharge portion 18.

The feeder portion 14 has a pair or conveyor rollers 20 and 22 and guides 24 and 26. The recording medium P is transferred from a lateral direction upwardly and fed to the preheat portion 16 by means of the feeder portion 14.

The preheat portion 16 has a conveyor 28 composed of three rollers and an endless bell, a pressure roller 30 depressed from the outside of the conveyor 28 to the endless belt, a heating unit 32 depressed to the pressure roller 30 from the inside of the conveyor 28 and an exhaust fan 34 for evacuating the interior of the preheat portion 16.

Such a preheat portion 16 heats the recording medium P prior to the recording by the ink jet to accelerate the dry of the ink ejected onto the recording medium P and to realize the high speed recording. The recording medium P fed from the feeder portion 14 is heated from the recording surface side by the heating unit 32, and is transferred to the recording portion 12 while being clamped and transferred by the conveyor 28 and the pressure roller 30.

The recording portion 12 has a recording head portion 50 and a recording medium conveyor portion 58. The recording head portion 50 has an ink jet head 52 having a head chip composed of a Si substrate, a recording control portion 54 and an ink cartridge 56. The ink jet head 52 is connected to the recording control portion 54.

The ink jet head 52 is a line head on a large scale in which the plurality of ink jet nozzles for ejecting ink liquid drops are arranged over a length exceeding at least one side of the recording medium P of a maximum width size to be image recorded for the printer 10. The ink jet nozzles are arranged in the direction perpendicular to the drawing plane of FIG. 1A.

Accordingly, the recording head portion 50 records the image at one time over the full recording width without scanning in the perpendicular direction to the drawing plane of FIG. 1A on the recording medium P transferred by a recording medium conveyor portion 58 having a belt 64 wound around conveyor rollers 60*a* and 60*b* and a drive roller 62.

The recorded medium P is discharged from a discharge portion 18 having a pair of rollers 72 and 74.

Note that, the density of the ink jet nozzles of the ink jet head 52 of the printer 10 is at 600 npi (nozzle/inch) or more, preferably at 900 npi or more, more preferably at 1,600 npi (nozzle/inch) or more. Thus, in the ink jet head with a high density, the effect of the present invention to be described is more effectively exhibited. Also, the ink jet head 52 is not limited to the line head but may be a serial type ink jet head in which the ink jet head 10 scans in a direction perpendicular to the feeding direction of the recording medium P.

Figure 2:
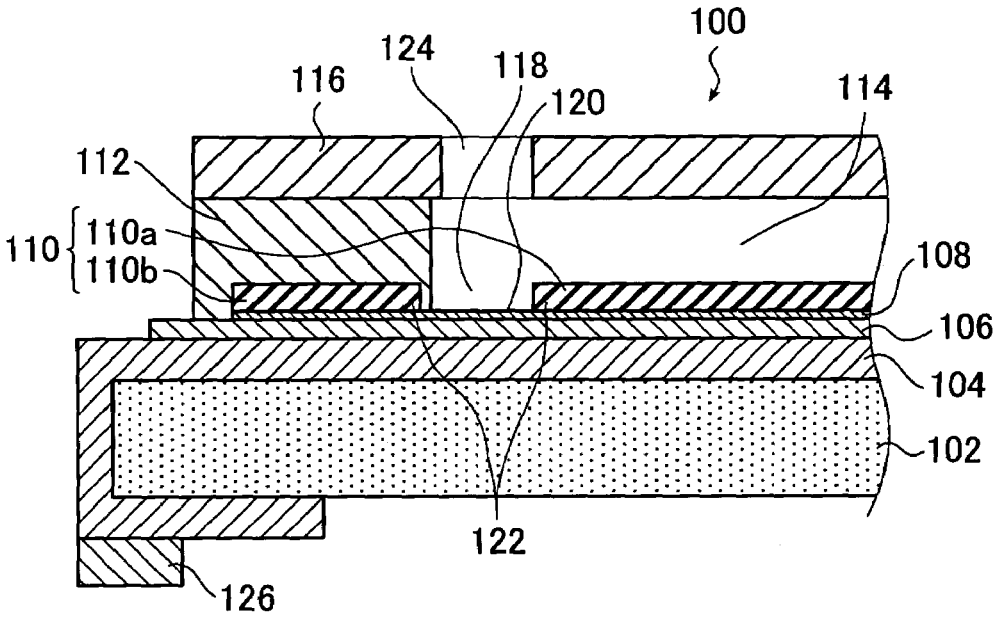
FIG. 2 is a schematic cross-sectional view showing a cross-section of an example of the ink jet head according to the present invention.

The head structure 100 corresponding to one ink jet nozzle of the ink jet head 52 of the printer 10 is shown in FIG. 2. Such head structures as shown in FIG. 2 are provided at a high density in the direction of ink jet nozzle arrangement (perpendicular to the drawing plane). Note that, the thickness in cross-sectional direction shown in FIG. 2 is exaggerated for easy understanding. This is the case also in FIGS. 3 through 5 as referred to below.

The head structure 100 shown in FIG. 2 has a substrate 102, a heat-transfer layer 104 as an upper layer adjacent to this substrate 102, a heat insulating layer 106 as an upper layer adjacent to this heat-transfer layer 104, a resistor layer 108 as an upper layer adjacent to this heat insulating layer 106, an electrode layer 110 (110*a*, 110*b*) as an upper layer adjacent to this resistor layer 108, a partitioning wall layer 112 and a plate layer 116 as an upper layer adjacent to this partitioning wall layer 112.

In this case, the parts of the electrode layer 110 are removed so that the underlying resistor layer 108 is exposed. The exposed part of the resistor layer 108 serves as a thin film resistor 120. The electrode layers 110*a* and 110*b* separated right and left as shown in the drawing serves as a conductive electrode 122. As a result, the heat generating heater 118 is formed using the thin film resistor 120 and the conductive electrode 122. Namely, the heat generating heater 118 has the thin film resistor 120 and a thin film conductive electrode.

On the other hand, the ink jet nozzles 124 bored in the plate layer 116 are arranged in positions facing the thin film resistors 120 in the perpendicular direction to the substrate 102. Namely, the inlet port ends of the nozzles of the ink jet nozzles 124 are arranged so as to face the thin film resistors 120 formed on the substrate 102.

Also, the partitioning wall layer 112 forms an ink flow passage 114 partitioned for each ink jet nozzle 124 by the partitioning wall. This ink flow passage 114 supplies the ink from the ink cartridge 56 and fills the ink to the interior of the ink jet nozzle 124.

In this case, the thin film resistor 120 generates heat by the current from the thin film conductive electrode 122 to heat the ink rapidly and to boil the part of the ink to form the bubbles. The expansion of the bubbles causes the ink liquid drops to be ejected substantially in the perpendicular direction (80 to 100 degrees) to the substrate 102 from the ink jet nozzles 124.

In this case, the thin film resistor 120 (resistor layer 108) is made of a ternary alloy of Ta—Si—O. The surface layer of the thin film resistor 120 that comes into contact with ink is previously oxidized in itself to generate a self-oxidized coating film (not shown), thus providing the heater surface of the heat generating heater 118. In the case where the thickness of the thin film resistor 120 is at, for example, 0.1 $\mu$m, the self-oxidized coating film is equal to or less than 0.01 $\mu$m in thickness, which is one tenth of the thickness of the thin film resistor 120. Such a self-oxidized coating of a Ta—Si—O ternary alloy has electric insulation and is superior in anti-cavitation and in addition, the thickness is thin as 0.01 $\mu$m or less. Accordingly, it is possible to heat the ink at a heating rate of $10^8$ or more (K/sec) (K: Kelvin) with the heat generated in the thin film resistor 120 to enhance the responsibility of the generation of the bubbles to the pulse signal and to save the applied voltage and to save the generated energy of the thin film resistor 120. Note that, in view of the fact that the ink liquid drop may be ejected in a stable manner, it is preferable that the heating rate of the thin film resistor 120 is at $10^8$ (K/sec) to $5\times10^8$ (K/sec).

Figure 3:
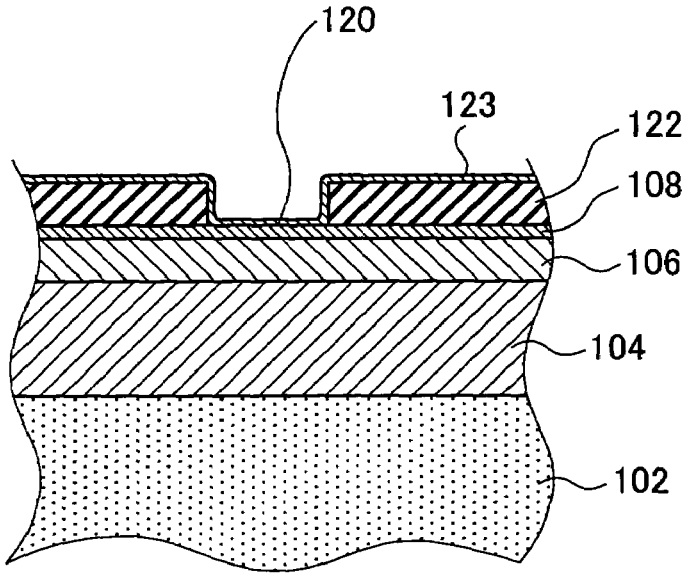
FIG. 3 is a cross-sectional view showing a principal part of another example of the ink jet head according to the present invention.

Note that, according to the present invention, it is possible to use alloy containing Si (silicon), Al (aluminum), N (nitrogen) or O (oxygen) component in addition to Ta as the resistive material of the thin film resistor 120 (resistor layer 108), which contains at least Ta metal in the form of composition. In this case, it is also possible to provide as a protective layer 123 as shown in FIG. 3 a silicon oxide, a silicon nitride, a silicon carbide or Ta metal on top of the thin film resistor 120. Although the protective layer 123 is of a single-layer type in FIG. 3, it may be formed of two or more layers. It is preferable that the total thickness of protective layers is equal to or less than 1 $\mu$m in view of saving the generated energy and the responsibility of the generation of the bubbles to the application of the pulse signals.

The partitioning wall layer 122 is formed or photosensitive polyimide resin. A thickness of this partitioning wall layer 112 is preferably equal to 15 $\mu$m or less.

The plate layer 116 is a polyimide plate attached to the upper layer of the partitioning wall layer 112 with an adhesive or the like, in which an ink jet nozzle 124 is formed substantially in the perpendicular direction (in the range of 80 to 100 degrees) by reactive dry etching or the like and inlet port end of the ink jet nozzle 124 is arranged to face the position of a thin film resistor 120 formed on the substrate 102 so that the ink liquid drop may be ejected substantially in the perpendicular direction from the ink jet nozzle 124.

It is preferable that the thickness of the plate layer 116 be equal to or less than 25 $\mu$m and it is preferable that the total thickness of the partitioning wall layer 112 and the plate layer 116 is equal to or less than 40 $\mu$m.

The total thickness of the partitioning wall layer 112 and the plate layer 116 is equal to or less than 40 $\mu$m, whereby the effective length of the ink jet nozzle, i.e., the distance from the top of the heater surface of the heat generating heater 118 that comes into contact with ink to the eject end of the ink jet nozzle 124 may be equal to or less then 40 $\mu$m and the maximum growth height of the bubble when the ink liquid drop is ejected by the generation of the bubble may be equal to or less than 40 $\mu$m. Accordingly, when the ink liquid drip is ejected by the generation of the bubble, the ink is separated into the ink to be ejected as the ink liquid drop and the ink to be left so that the ink to be ejected may be ejected as the ink liquid drop and in addition, there is no splash of the ink.

Furthermore, it is preferable that the profile of the inlet port end (end facing the heat generating heater 118) of the ink let nozzle 124 be included in the profile of the thin film resistor 120, that is, the profile of the heater surface of the heat generating heater, when the profile of the inlet port end is projected onto the heater surface of the heat generating heater 118. Namely, in the case where the inlet port end of the ink jet nozzle 124 has a profile of a circular shape with a specified diameter and the thin film resistor 120 has a profile of a square shape, the circular profile of the inlet port end is included in the square profile of the thin film resistor 120. For example, the inlet port end of the ink jet nozzle 124 may have a circular profile of 15 $\mu$m in diameter and the thin film resistor 120 a 20 $\mu$m×20 $\mu$m square profile in which the circular profile is included.

The relationship between the profile of the inlet port end of the ink jet nozzle 124 and the profile of the heater surface of the heat generating heater 118 is set as described above whereby, when the ink liquid drop is ejected by the generation of the bubble, the ink is surely divided by the expansion of the bubble into the ink to be ejected as the ink liquid drop and the ink to be left and, as a consequence, the ink to be ejected can be ejected as the ink liquid drop.

The heat generating heater 118 and the ink jet nozzle 124 are formed on the substrate 102.

The substrate 102 is made of material having a thermal conductivity of 15 (W/m/K) or less. Silicon (Si) having the thermal conductivity of about 150 (W/m/K) is excluded from the substrate material according to the present invention. For example, the substrate material having the thermal conductivity of 15 (W/m/K) or less is exemplified as amorphous material, more specifically, ceramic material such as quartz glass or non-alkaline glass and may be exemplified as heat-resistive high molecular resin material such as polyimide or aramid. Also, even if it is alloy, one having the thermal conductivity of 15 (W/m/K) or less may be used For example, Ni-based and Ti-based alloy materials such as Incoloy 800, Inconel 600, Inconel 750, Hastelloy C, and Nimonic 90, which have the thermal conductivity in the range of 11 to 14 (W/m/K) may be included. ("Incoloy" and "Inconel" are trade names of the products of Inco Limited).

Note that, it is preferable that in case of the amorphous material or alloy material, the thickness of the substrate 102 be equal to 100 $\mu$m or more and in case of the high molecular resin material, the thickness be equal to or more 10 $\mu$m in view the operationability to work and form the ink jet nozzle 124 or the heat generating heater 118 on the substrate 102.

A heat-transfer layer 104 is selected from the group consisting of metal material such as Cu, Al, or Si and Mo, W, Rh, Mg, or diamond like carbon solely or may be selected from the alloy of these kinds of material. The thickness thereof is equal to or greater than 10 $\mu$m. The heat-transfer layer 104 is formed through a known PVD method or a CVD. Otherwise, the heat-transfer layer 104 is formed of a laminate of a metal foil and a high molecular adhesive layer may be formed between the substrate 102 and the heat-transfer layer 104.

Furthermore, in the case where the substrate 102 is formed of a glass plate, a bulk of silicon is bonded by means of positive electrode bonding and the bulk of silicon bonded is polished down to a desired thickness to form the heat-transfer layer 104.

Note that, it is preferable that the thermal conductivity of the heat-transfer layer 104 be equal to or greater than 100 (W/m/K).

Such the heat-transfer layer 104 is formed continuously from the top face of the substrate on which the heat generating heater 118 is formed to the back face of the substrate opposite to the top face so as to surround the end portions of the substrate 102. In this case, a heat release portion 126 composed of a Peltier element is formed on the back face. The distance from the heat-transfer layer 104 just under the position of the heat generating heater 118 to the heat release portion 126 is set at, for example, 2 mm or less, preferably 1 mm or less.

On the back face of the substrate 102, the Peltier element, which actively absorbs the heat transmitted from the heat generating heater 118 through the heat-transfer layer 104 by causing the current to flow therethrough, is formed as the heat release portion 126.

Note that, it is possible to use a heat-releasing fin for passively releasing the heat instead of the Peltier element as the heat release portion 126. It is also possible to release heat to the ink supplied to the ink flow passage 114 by a heat exchange with the ink.

Note that, the substrate 102 may also have such a configuration that the heat release portion 126 is formed on the back face of the substrate opposite to the top face thereof on which the heat generating heater 118 is formed, and the heat-transfer member is provided which penetrates the substrate 102 from the top face to the back face thereof and connects the heat-transfer layer 104 on the top face and the heat release portion 126 on the back face of the substrate to each other.

Furthermore, the heat release portion 126 may be provided on the top face of the substrate 102.

Such heat release via the heat-transfer layer 104 will be described in detail below.

Figure 4:
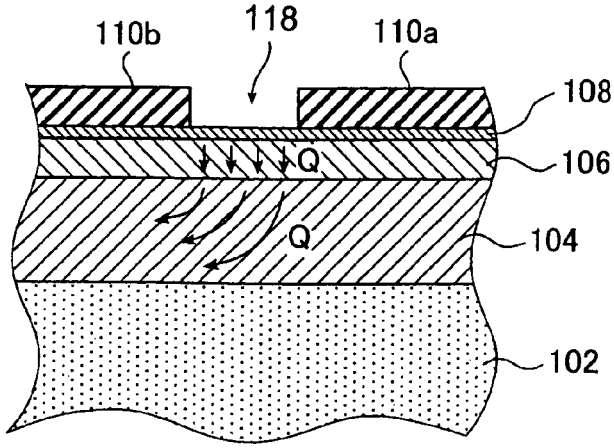
FIG. 4 is a view illustrating a flow of heat in the ink jet head shown in FIG. 2.

Note that, as shown in FIG. 4, the heat generated from the heat generating heater 118 is consumed in generating the bubble of the ink, and on the other hand, the rest of the heat Q is caused to flow toward the substrate 102 through the heat insulating layer 106 from the heat generating heater 118. However, the reason why the thickness of the heat-transfer layer 104 is made to be 10 $\mu$m or more is to positively and effectively transmit the heat Q flowing toward the substrate 102 along the temperature gradient toward the heat release portion 126.

In the conventional ink jet head, i.e., the head structure where the heat generating resistor is formed on the insulating layer on the silicon substrate, since the heat is caused to well flow and to be released in the direction of the thickness of the silicon substrate, there is no fear that the heat is excessively accumulated in the silicon substrate or the heat generating heater and the ink liquid drop may be ejected for a long period of time. The reason for this is that the heat resistance R when the heat is transmitted toward the back face from the top face of the silicon substrate is relatively low.

In general, assuming that $\lambda$ is the heat conductivity of the material for heat transfer, S is the cross-sectional area of the heat flux and L is the length for heat transfer, the heat resistance R is represented by the following formula (1):

$$R=(1/\lambda)\cdot(L/S) \quad (1)$$

In the case of a conventional ink jet head where the heat generating resistor constituting the heat generating heater is formed on the heat insulating layer, which is formed on the silicon substrate, it can be considered that heat flows from the heat generating heater through the heat insulating layer toward the silicon substrate and then efficiently flows in the directions of the thickness and the width of the substrate.

The inventor has found from the above fact that the heat resistance R when heat flows in the silicon substrate in the width direction is estimated to be lower than the heat resistance R when heat flows from the heat generating heater toward the silicon substrate because of a high heat conductivity $\lambda$ and a large thickness or the silicon substrate and it can be considered with primary approximation that the heat from the heat generating heater flows through the heat insulating layer toward the silicon substrate just below the heater (rate-limiting step). Consequently, the inventor has found that, in the conventional ink jet head as above, the cross-sectional area S of the heat flux in the above formula (1) can be approximated by the area or the heat generating heater (namely, the area of the bare part of the heat generating resistor that is not covered with the electrode layer) and the length for heat transfer L can be approximated by the thickness of the silicon substrate. Thus, in the case of a conventional ink jet head with a line density of 600 npi (nozzles per inch), for instance, the cross-sectional area S of the heat flux can be approximately 20 to 40 $\mu m^2$ and the length for heat transfer L can be approximately 600 to 650 $\mu$m.

The inventor has also found that, when heat flows in the silicon substrate in the width direction, the cross-sectional area S of the heat flux can be approximated by the area of the cross section of the silicon substrate that extends along the width of the heat generating heater (namely, the product of the heater size and the thickness of the silicon substrate) and the length for heat transfer L can be approximated by half a length in the direction of the width of the silicon substrate.

It can be understood with respect to such a conventional ink jet head as above that the heat resistance R is relatively low and heat is caused to flow effectively in the silicon substrate in the width direction to be released because the head uses a silicon substrate having a higher heat conductivity $\lambda$ compared with the substrate 102 used in the present invention and that as a result, the silicon substrate and the periphery of the heat generating heater are not excessively heated and the ink liquid drop can be ejected for a long period of time.

However, in the ink jet head having the heat sink layer made of metal such as aluminum, copper, or gold, which have the high thermal conductivity and the thickness of 1 to 2 $\mu$m on the soda lime glass substrate, the heat insulating layer thereon and the heat generating heater thereon in the above-described JP 2001-191529 A, the heat resistance R is high. The inventor has found the reason for this in that: in this ink jet head, in which the heat from the heat generating heater should flow through the heat insulating layer and then in the heat sink layer because the heat release to the glass substrate having a low thermal conductivity $\lambda$ is less likely to occur, the heat resistance R when heat flows in the heat sink layer in the width direction (rate-limiting step) is more critical than the heat resistance R when heat flows from the heat generating heater toward the heat sink layer, resulting from a small thickness of the heat sink layer. Thus, there arises a problem of high heat resistance R due to a small thickness of the heat sink layer.

As a result of the above finding, the present inventor has paid his attention to the fact that the direction of flow of the heat in the heat-transfer layer 104 as described above is actively utilized, that is to say, the direction of flow of the heat in the heat-transfer layer 104 is sat to the direction of the plane of the heat-transfer layer 104 (transversal in the drawing) to thereby increase the area S of the cross section of the heat-transfer layer 104 that extends along the width of the heat generating heater (namely, the product of the size in the direction of the width of the heat generating heater 118 and the thickness of the heat-transfer layer 104) and have found out that it is necessary to increase the thickness of the heat-transfer layer 104 to be 10 $\mu$m or more.

On the other hand, the heat insulating layer 106 is made of heat insulating material having the heat conductivity in the range of 0.1 to 10 (W/m/K). The thickness thereof is 0.5 to 10 $\mu$m. More preferably, the thickness is in the range of 1 to 2 $\mu$m.

For example, silicon oxide ($SiO_2$) having the thermal conductivity of 1.4 (W/m/K) and the thickness of 1 $\mu$m may be used. It is also possible to use Si nitride ($Si_3N_4$), Si carbide (SiC) or polyimide resin material.

The heat insulating layer 106 is used to prevent to some extent the transmission of heat to the heat-transfer layer 104 so that the heat generated by the heat generating heater 118 may efficiently be used to heat the ink to generate the bubble, and to realize the electric insulation.

Figure 5:
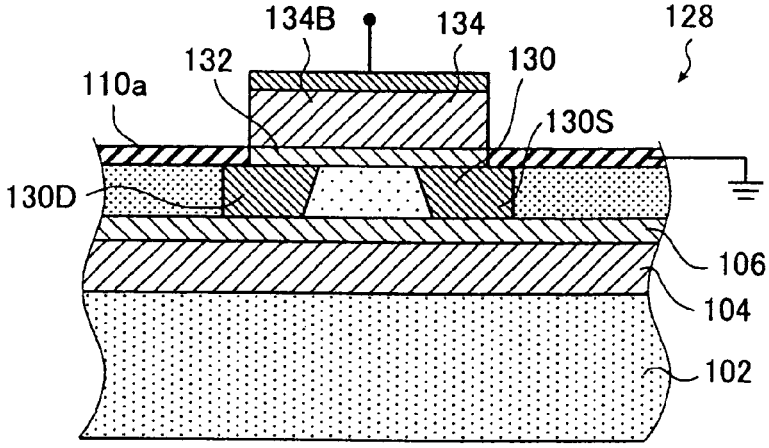
FIG. 5 is a schematic cross-sectional view showing a cross-section or another constituent part of an example of the ink jet head according to the present invention.

Also, the ink jet head 52 is provided with a control circuit 128 for selecting and driving the heat generating heater 118. As shown in FIG. 5, the control circuit 228 is formed on the same substrate 102 where the heat generating heater 118 is formed. Namely, polycrystalline silicon layers 130 and 134 are formed on the heat insulating layer 106. An FET is formed by these polycrystalline silicon layers 130 and 134 to form the control circuit 128.

In formation of the FET, the polycrystalline silicon layers 130 and 134 are formed on the heat insulating layer 106 to have a thickness of 0.02 to 0.6 $\mu$m by using a well known CVD method, and thereafter, a p-type or an n-type doping process is effected by a well known heat diffusion or a well known ion injection of boron (B) and phosphorus (P) atoms to form a drain and a source of the FET. Then, this is formed into a predetermined pattern by a well known masking or etching process. Furthermore, the other polycrystalline silicon layer 134 is formed in the same manner described above through the oxidized layer 132 such as $SiO_2$ on the upper layer of the polycrystalline silicon layer 130 and subjected to the doping processes to form the FET gate. The drain of such an FET causes the drain current to flow to the electrode layer 110*a* in response to a pulse signal to be applied to the gate and to heat the thin film resistor 120. It is preferable that the polycrystalline silicon layers 130 and 134 be formed of low temperature polycrystalline silicon having the relatively low formation temperature (substantially 500 to 600° C.).

The head structure 100 is thus constructed.

In such a head structure 100, the control circuit 128 is driven so that the current flows from the thin film conductive electrode 122 to the thin film resistor 120 to generate the heat, the ink is heated at a heating rate of $10^8$ (K/sec) or more to form the bubble and the ink liquid drop is ejected from the ink jet nozzle 124 by the expansion force of this bubble.

The heat generated in the thin film resistor 120 is fed for boiling the ink, whereas the rest of the heat is transmitted in the direction of the substrate 102 and reaches the heat-transfer layer 104 through the heat insulating layer 106. The heat-transfer layer 104 is connected to the heat release portion 126 for releasing the heat transmitted from the heat-transfer layer 104 so that the temperature gradient is formed in the heat-transfer layer 104 from the heat generating heater 118 to the heat release portion 126. Accordingly, as shown in FIG. 4, the heat flow transmitted from the heat insulating layer 106 perpendicularly to the substrate 102 changes its direction such that it runs parallel to the substrate 102, so that the heat flows toward the heat release portion 126 along the temperature gradient of the heat-transfer layer 104.

In this case, the heat-transfer layer 104 has to have a predetermined thickness or more so as to reduce the heat resistance R of the heat flowing along the temperature gradient of the heat-transfer layer 104.

Namely, in order to suppress the elevation of the temperature around the heat generating heater 118, it is important to increase the area of the cross-section in accordance with the above-described formula (1) to a predetermined level or more to reduce the heat resistance R and to perform the quick heat transfer. In this case, since the heat flows along the temperature gradient of the heat-transfer layer 104, the cross-sectional area S is determined by the size of the thin film resistor 120 of the heat generating heater 118 and the thickness of the heat-transfer layer 104. Then, in order to keep the eject frequency of the ink at 10 kHz or more, more preferably, 20 kHz or more, it is necessary according to the Examples as described below to keep the thickness of the heat-transfer layer 104 to 10 μm or more.

Figure 6:
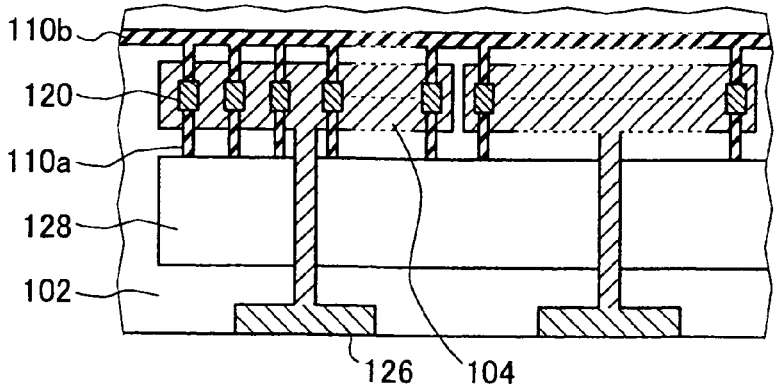
FIG. 6 is a view illustrating the arrangement of respective layers in another example of the ink jet head of the present invention.

FIG. 6 shows an example of the ink jet head having a configuration different from that of the ink jet head as shown in FIG. 2 in which heat is released by the heat release portions 126, illustrating the arrangement of heat generating resistors formed on a substrate, electrode layers for applying voltage to the heat generating resistors, a control device for controlling the voltage applied to the electrode layers, and heat-transfer layers, as constituent elements of the ink jet head shown. The substrate, the heat generating resistor, the electrode layers, the control device and the heat-transfer layer as shown in FIG. 6 have structures and functions similar to those of the substrate 102, the heat generating resistor 120, the electrode layers 110*a* and 110*b*, the control device 128 and the heat-transfer layer 104 as shown in FIGS. 2 and 5 so that they are denoted by like numerals and the explanation of their structures and functions omitted.

A plurality of heat generating resistors 120 are arranged on the substrate 102 in alignment in the transversal direction in the drawing at even intervals. Above each heat generating resistor 120 (namely, above the drawing plane of FIG. 6), an ink jet nozzle 124 (not shown) is arranged correspondingly. The electrode layer 10*b* is provided as an electrode common to the respective heat generating resistors 120 and the electrode layer 110*a* connected with the control circuit 128 is provided so that the heat generating resistors 120 may individually generate heat.

A heat insulating layer (not shown) is formed underneath the heat generating resistors 120 and underneath the heat insulating layer further the heat-transfer layer 104.

In this embodiment, the heat-transfer layer 104 is provided in a plural number, each formed as a lower layer common to a predetermined number of heat generating resistors 120 among those on the substrate 102. Each heat-transfer layer 104 formed as above extends across the control device 128 to the heat release portion 126 of its own. Since a heat insulating layer (not shown) is formed between the control device 128 and the part of the heat-transfer layer 104 that extends across the control device 128, heat in the heat-transfer layer 104 is not transmitted to the device 128.

The heat release portions 126 are formed on the margin of the substrate 102 so that heat may be released into the air.

Under such a configuration, the heat flow transmitted from the heat generating resistor 120 through the heat insulating layer (not shown) perpendicularly to the substrate 102 changes its direction such that it runs parallel to the substrate 102, so that heat flows across the control device 128 toward the heat release portion 126 along the temperature gradient of the heat-transfer layer 104.

In this embodiment also, the thickness of the heat-transfer layers 104 is set to 10 μm or more in order to allow heat to efficiently flow.

The heat-transfer layer 104 in this embodiment is not formed as a single layer common to all the heat generating resistors 120 on the substrate 102 but as a plurality of layers each corresponding to a predetermined plural number of heat generating resistors 120 among those formed on the substrate 102 and collecting heat from the heat generating resistors 120 to which it corresponds. Each heat-transfer layer 104 is in the form of wiring pattern, as having a part extending across the control device 128 to be connected with the heat release portion 126 just like a connecting wire. Consequently, when the substrate 102 used in the construction of the ink jet head is of a shape elongated in one direction, the wiring distance can be reduced to realize a more efficient heat transfer by forming the heat release portions 126 on the part of a longer side of the substrate 102 and allowing the heat-transfer layers 104 to extend in the form of wiring pattern to the heat release portions 126 thus formed. In particular, adverse effects of heat on the operation of the control device 128 can be lessened and the peeling of the heat-transfer layers 104 themselves and the warpage of the substrate 102 can be decreased as compared with the case of the heat-transfer layer 104 formed as a single layer common to all the heat generating resistors 120 and extending as such across the control device 128. Although the heat-transfer layers 104 in the form of wiring pattern as described above are each formed as corresponding to a predetermined plural number of heat generating resistors 120 among those on the substrate 102, it is also possible to form a plurality of heat-transfer layers in the form of wiring pattern which correspond to a plurality of heat generating resistors, respectively.

Figure 7A:
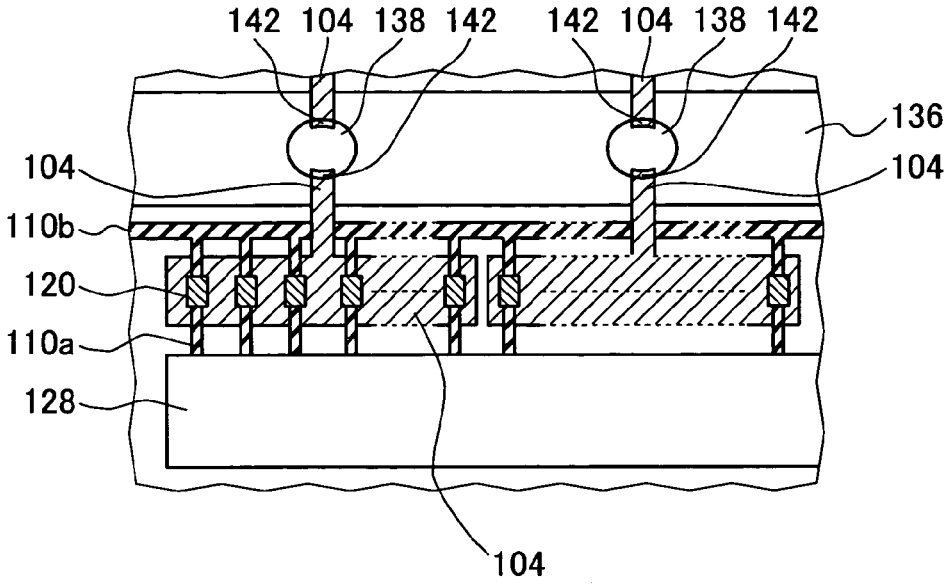
FIG. 7A is a view illustrating the arrangement of respective layers in yet another example of the ink jet head of the present invention.
Figure 7B:
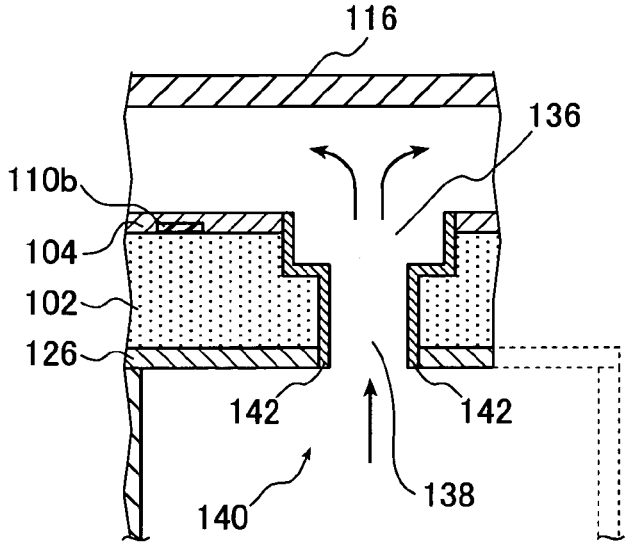
FIG. 7B is a cross-sectional view showing a cross-section of the through hole shown in FIG. 7A and its neighborhood.

FIGS. 7A and 7B show an example of the ink jet head having a configuration different from that of either of the ink jet heads as shown in FIGS. 2 and 6 in which heat is released by the heat release portions 126, illustrating the arrangement of heat generating resistors formed on a substrate, electrode layers for applying voltage to the heat generating resistors, a control device for controlling the voltage applied to the electrode layers, and heat-transfer layers, as constituent elements of the ink jet head shown. The substrate, the heat generating resistor, the electrode layers, the control device and the heat-transfer layer as shown in FIG. 7 have structures and functions similar to those of the substrates 102, the heat generating resistors 120, the electrode layers 110*a* and 110*b*, the control devices 128 and the heat-transfer layers 104 as shown in FIGS. 2 and 6 so that they are denoted by like numerals and the explanation of their structures and functions omitted.

In the embodiment as shown in FIGS. 7A and 7B, a common ink groove 136 for smoothly supplying ink is formed in the substrate 102 in parallel with the heat generating resistors 120 arranged in alignment and in the bottom of the common ink groove 136 are formed at intervals through holes 138 which penetrate the substrate 102.

It should be noted that the heat generating resistors 120, the electrode layers 110*a* and 110*b*, the control devices 128 and the heat-transfer layers 104 are formed symmetrically on both sides of the common ink groove 136 in the substrate 102 as having like structures.

The through holes 138 link the side of the substrate 102 on which the heat generating resistors 120 are formed (i.e., the top face side) with an ink supply channel 140 formed on the side of the substrata 102 opposite to the top face side (i.e., the back face side). The ink supply channel 140 is connected with an ink cartridge (not shown). Accordingly, ink is supplied from the ink cartridge to the through holes 138 and the common ink groove 136 and the ink coming to the common ink groove 136 is fed to ink flow passages.

The heat-transfer layers 104 located under the heat generating resistors 120 are allowed to extend in the form of wiring pattern toward the common ink groove 136 and the through holes 138. On the other hand, heat-transfer members 142 for transmitting heat from the heat-transfer layers 104 to heat release portions 126 formed on the back face of the substrate 102 are formed along the through holes 138 such that they connect the heat-transfer layers 104 and the heat release portions 126.

Each heat release portion 126 has a large heat-releasing surface provided by using heat-releasing fins etc. in order to release heat to the ink in the ink supply channel 140 directly or via a protective layer (not shown) so that heat is released to the ink supplied from the ink cartridge. Heat may also be released by the heat-transfer members 142 located in the through holes 138 to the ink flowing through the through holes 138 toward the common ink groove 136.

Under such a configuration as above also, the heat flow transmitted from the heat generating resistor 120 through a heat insulating layer (not shown) perpendicularly to the substrate 102 changes its direction such that it runs parallel to the substrate 102, so that heat flows along the temperature gradient of the heat-transfer layer 104 and through the heat-transfer member 142 formed in the through hole 138 toward the heat release portion 126.

In order to allow heat to efficiently flow, it is preferable to set the thickness of the heat-transfer layers 104 to 10 μm or more.

The heat release portions 126 in this embodiment are so located that they release heat to the ink in the ink supply channel 140. It is, however, also possible according to the present invention to otherwise locate the heat release portions 126 for releasing heat to the ink so long as ink is at least heated before elected in an manner effective in ejection.

EXAMPLES

The head structure 100 shown in FIG. 2 was prepared and the continuous eject time of the ink liquid drop was inspected while changing the thickness of the heat-transfer layer 104 variously.

The substrate 102 was a non-alkaline glass.

The thin film resistor 120 was made using a Ta—Si—O ternary alloy as a resistive material and a self-oxidized coating of about 0.01 μm thick was formed on the surface layer of the resistor 120 that comes into contact with ink while the heater surface was defined as having a 20×20 μm square profile and a thickness of 0.1 μm. The cross-sectional profile of the ink jet nozzle 124 was of a circular shape having a diameter of 15 μm.

The heat insulating layer 106 was made of $SiO_2$ at a thickness of 1 μm as the insulating material, and the heat-transfer layer 104 was formed by laminating copper foil on the substrate 102.

Note that, in the heat release portion 126, the above-described Peltier element was used for absorbing the heat.

The pulse supply time period of the thin film resistor 120 was 3 μsec and the ink was ejected at the ink eject frequency of 10 kHz continuously so that the continuous eject time period of the ink liquid drop was inspected. Note that, the observation time of the continuous ejection was 20 minutes and the continuous eject time of the ink liquid drop was measured until the continuous ejection disappeared.

Note that, the heat-transfer layers 104 were prepared at thickness of 20 μm, 10 μm, 5 μm and 2 μm, respectively, and the head structure 100 having the density of the ink jet nozzles corresponding to 600 npi was prepared. Furthermore, the head structure having the density of the ink jet nozzles corresponding to 600 npi without the heat-transfer layer 104 and the heat insulating layer 106 was also prepared. The continuous eject time of the ink liquid drop was inspected.

TABLE 1

| | Thickness of heat-transfer layer/ thickness of heat insulating layer | Continuous eject time |
|---|---|---|
| Example 1 | 20 μm/1 μm | No eject interruption occurred during observation |
| Example 2 | 10 μm/1 μm | No eject interruption occurred during observation |
| Comparative Example 1 | 0 μm/0 μm | Less than one second |
| Comparative Example 2 | 2 μm/1 μm | Less than one second |
| Comparative Example 3 | 5 μm/1 μm | Less than one second |

According to the above table, it has been found that the ejection was well carried out during the observation in any case of the heat-transfer layer 104 having the thickness of 10 μm or more and thus, the thickness of the heat-transfer layer 104 had to be 10 μm or more.

Thus, in the ink jet head using the substrate having the heat conductivity of 15 (W/m/K) or less, the heat-transfer layer having a thickness of 10 μm or more is interposed between the substrate and the heat generating heater so that the ejection of the ink liquid drop may be well carried out. In particular, in order to accelerate the saving of the heating energy for ejecting the ink liquid drop, it is preferable to use on the surface layer of the thin film resistor 120 that comes into contact with ink as the resistive material of the thin film resistor a Ta—Si—O ternary alloy which can have a self-oxidized coating formed thereon, that is superior in anti-cavitation with electric insulation.

The above-described embodiment is of a top shooter type for ejecting the ink liquid drop substantially in the vertical direction to the substrate 102 but the ink jet head according to the present invention may be of a side shooter type for ejecting the ink liquid drop substantially in the horizontal direction to the substrate.

The ink jet head and the ink jet printer according to the present invention have been described above in detail. However, the present invention is not limited to the above-described specific embodiment but it is possible to make various changes or modifications within the scope without departing the spirit of the present invention.

As described above in detail, according to the present invention, in the ink jet head using the substrate having the heat conductivity of 15 (W/m/K) or less, by interposing the heat-transfer layer having the thickness of 10 μm or more between the substrate and the heat generating heater, or by connecting the heat-transfer layer to the heat release portion for releasing heat to the ink, even if the ink liquid drop is continuously ejected, it is possible to suppress the temperature elevation around the heat generating heater and to enhance the printing speed upon the printing.

What is claimed is:

1. An ink jet head comprising:

an inkjet nozzle from which an ink liquid drop is ejected onto a recording medium;

a substrate having a heat conductivity of 15 (W/m/K) or less;

a heat-transfer layer having a thickness of 10 μm or more which is formed on the substrate;

a heat insulating layer which is adjacently formed on top of the heat transfer layer; and a heat generating heater which is adjacently formed on top of the heat insulating layer, said heat generating heater having:

a thin film resistor for boiling a part of ink to generate a bubble and allow the ink liquid drop to be ejected from the ink jet nozzle by an expansion of the bubble; and a thin film conductive electrode for supplying a current to the thin film resistor.

2. The ink jet head according to claim 1, wherein said heat-transfer layer is made of metal selected from the group consisting of Cu, Al ans Si.

3. The ink jet head according to claim 1, wherein said heat-transfer layer is formed continuously from a top face of the substrate on which said heat generating heater is formed to a back face of the substrate opposite to the top face to surround end portions of the substrate, and a heat release portion for releasing the heat transmitted from said heat generating heater through said heat-transfer layer is formed on the back face of the substrate.

4. The ink jet head according to claim 1, wherein said substrate is provided with the heat release portion on the back face opposite to the top face thereof on which said heat generating heater is formed; and a heat-transfer member penetrating said substrate from the top face to the back face and connecting said heat transfer layer on said top face and the heat release portion on said back face to each other, is formed.

5. The ink jet head according to claim 1, wherein said heat-insulating layer has a heat conductivity of 0.1 to 10 (W/m/K).

6. The ink jet head according to claim 1, wherein said heat insulating layer is made of an Si oxide, and Si nitride, and Si carbide, or a polyimide resin material.

7. The ink jet head according to claim 1, wherein said thin film resistor contains Ta metal in the form of a composition.

8. The ink jet head according to claim 7, wherein said thin film resistor uses a Ta—Si—O ternary alloy as a resistive material.

9. The ink jet head according to claim 1, wherein said heat generating heater has a protective layer having a thickness of 1 $\mu$m or less formed on to of said thin film resistor.

10. The ink jet head according to claim 1, wherein said ink jet nozzle is arranged such that an inlet port end of said ink jet nozzle faces said thin film resistor formed on the substrate, and the ink liquid drop is ejected from said ink jet nozzle substantially in a direction perpendicular to the substrate.

11. The ink jet head according to claim 10, wherein a distance from a heater surface of said heat generating heater to an eject end of said ink jet nozzle is 40 $\mu$m or less, and a profile of the inlet port end of said ink jet nozzle is included in a profile of the heater surface of said heat generating heater when projected onto the heater surface of said heat generating heater.

12. The ink jet head according to claim 1, further comprising:

a control circuit for controlling driving of said heat generating heater which is formed of polycrystalline silicon layer formed on said substrate.

13. The ink jet head according to claim 1, wherein said heat-transfer layer is made of one metal material selected from the group consisting of Cu, Al, Si, Mo, W, Rh, and Mg and alloys thereof, or diamond-like carbon.

14. The ink jet head according to claim 1, wherein thermal conductivity of said heat-transfer layer is equal to or greater than 100 W/m/K.

15. The ink jet head according to claim 1, wherein said thin film resistor is formed on said heat insulating layer and said thin film conductive electrode is formed on said thin film resistor.

16. The ink jet head according to claim 1, further comprising:

a heat release portion for releasing heat to the ink supplied for ink ejection, wherein said heat-transfer layer is connected to said heat release portion.

17. The ink jet head according to claim 16, wherein said heat-release portion is located in an ink flow path up to said heat generating heater and releases the heat to the ink to be supplied to said heat generating heater for ink ejection by heat exchange with the ink.

18. The ink jet head according to claim 1, wherein said heat insulating layer has a thickness of 0.5 to 10 $\mu$m.

19. An ink jet head comprising:

an in jet nozzle from which an ink liquid drop is ejected onto a recording medium, a substrate having a heat conductivity of 15 (W/m/K) or less;

a heat transfer layer which is formed on the substrate;

a heat insulating layer which is adjacently formed on top of the heat-transfer layer; and a heat generating heater which is adjacently on top of the heat insulating layer, said heat generating heater having:

a thin film resistor for boiling a part of ink to generate a bubble and to allow the ink liquid drop to be ejected from the ink jet nozzle by an expansion of the bubble; and a thin film conductive electrode for supplying a current to the thin film resistor, wherein said heat-transfer layer is connected to a heat release portion for releasing heat to the ink supplied for ink ejection.

20. The ink jet head according to claim 19, wherein a plurality of said heat generating heaters are formed on top of said heat-transfer layer, as being arranged in parallel; and said heat-transfer layer constitutes a wiring pattern which transmits heat from the plurality of heat generating heaters collectively to said heat release portion.

21. The ink jet head according to claim 19, wherein said heat release portion is formed on a back face of said substrate opposite to a top face thereof on which said heat generating heater is formed; and said substrate is provided with a heat-transfer member which is intended to penetrate said substrate from the top face to the back face and connect said heat-transfer layer on said top face and the heat release portion on said back face to each other.

22. The ink jet head according to claim 21, wherein said substrate has a through hole formed therein for supplying ink for ink ejection from the back face toward the top face of said substrate; and said heat-transfer member is provided along said through hole.

23. The ink jet head according to claim 19, wherein said heat release portion is located in an ink flow path up to said heat generating heater and releases the heat to the ink to be supplied to said heat generating heater for ink ejection by heat exchange with the ink.

24. The ink jet head according to claim 19, wherein said heat insulating layer has a heat conductivity of 0.1 to 10 (W/m/K).

25. The ink jet head according to claim 19, wherein thermal conductivity of said heat-transfer layer is equal to or greater than 100 (W/m/K).

26. The ink jet head according to claim 19, wherein said heat insulating layer has a thickness of 0.5 to 10 $\mu$m.

27. An ink jet printer having an ink jet head, said ink jet head comprising:

an ink jet nozzle from which an ink liquid drop is ejected onto a recording medium;

a substrate having a heat conductivity of 15 (W/m/K) or less;

a heat-transfer layer having a thickness of 10 $\mu$m or more which is formed on the substrate;

a heat insulating layer which is adjacently formed on top of the heat-transfer layer; and a heat generating heater which is adjacently formed on top of the heat insulating layer, said heat generating heater having:

a thin film resistor for boiling a part of ink to generate a bubble and allow the ink liquid drop to be ejected from the ink jet nozzle by an expansion of the bubble; and a thin film conductive electrode for supplying a current to the thin film resistor.

28. An ink jet printer having an ink jet head, said ink jet head comprising:

an ink jet nozzle from which an ink liquid drop is ejected onto a recording medium;

a substrate having a heat conductivity of 15 (W/m/K) or less;

a heat-transfer layer which is formed on the substrate;

a heat insulating layer which is adjacently formed on top of the heat-transfer layer; and a heat generating heater which is adjacently formed on top of the heat insulating layer, said heat generating heater having:

a thin film resistor for boiling a part of ink to generate a bubble and allow the ink liquid drop to be ejected from the ink jet nozzle by an expansion of the bubble; and a thin film conductive electrode for supplying a current to the thin film resistor, wherein said heat-transfer layer is connected to a heat release portion for releasing heat to the ink supplied for ink ejection.

* * * * *

UNITED STATES PATENT AND TRADEMARK OFFICE

CERTIFICATE OF CORRECTION

PATENT NO. : 6,981,760 B2
DATED : January 3, 2006
INVENTOR(S) : Yamamoto

It is certified that error appears in the above-identified patent and that said Letters Patent is hereby corrected as shown below:

Column 15,
Line 14, replace “ans” with -- and --.
Line 40, replace “Ta—Si—O” with -- Ta-Si-O --.

Signed and Sealed this

Eighteenth Day of April, 2006

JON W. DUDAS
*Director of the United States Patent and Trademark Office*